US005406170A

United States Patent [19]

Uemura et al.

[11] Patent Number: 5,406,170

[45] Date of Patent: Apr. 11, 1995

[54] LIGHT EMITTING DEVICE RESISTANT TO DAMAGE BY THERMAL EXPANSION

[75] Inventors: Sashiro Uemura; Yoshiyuki Nishii; Isamu Kanda; Kazunori Tatsuda; Yukiharu Seko; Hiroshi Kamogawa; Tokuhide Shimojyo, all of Mie; Zenichiro Hara, Nagasaki; Nobuo Terazaki, Nagasaki; Shunichi Futatsuishi, Nagasaki; Kozaburo Shibayama, Nagasaki; Shuji Iwata, Hyogo, all of Japan

[73] Assignees: Ise Electronics Corporation, Ise; Mitsubishi Denki Kabushiki Kaisha, Tokyo, both of Japan

[21] Appl. No.: 162,949

[22] Filed: Dec. 8, 1993

Related U.S. Application Data

[62] Division of Ser. No. 851,462, Mar. 12, 1992, Pat. No. 5,304,083.

[30] Foreign Application Priority Data

Jul. 16, 1991 [JP] Japan ..... 3-174899

[51] Int. Cl.[6] ..... H01J 1/54

[52] U.S. Cl. ..... 313/495; 313/497; 313/422; 315/169.4; 445/24

[58] Field of Search ..... 313/495, 497, 422; 315/169.4; 445/24, 25, 35, 44

[56] References Cited

U.S. PATENT DOCUMENTS

| | | | |
|---|---|---|---|
| 2,731,578 | 1/1956 | McCullough . | |
| 3,299,305 | 1/1967 | Kreuder | 313/495 |
| 3,599,027 | 8/1971 | Koshizuka et al. | 445/24 |
| 4,893,056 | 1/1990 | Hara et al. . | |
| 4,900,981 | 2/1990 | Yamazaki et al. | 313/495 |
| 4,954,885 | 9/1990 | Ito et al. . | |
| 4,970,430 | 11/1990 | Kamogawa et al. | 313/495 |
| 4,972,116 | 11/1990 | Tatsuda et al. | 313/422 |
| 5,341,065 | 8/1994 | Uemura et al. | 313/495 |

FOREIGN PATENT DOCUMENTS

| | | |
|---|---|---|
| 57-189452 | 11/1982 | Japan . |
| 62-10849 | 1/1987 | Japan . |
| 1-100854 | 4/1989 | Japan . |

*Primary Examiner*—Donald J. Yusko
*Assistant Examiner*—Matthew J. Esserman
*Attorney, Agent, or Firm*—Burns, Doane, Swecker & Mathis

[57] ABSTRACT

The present invention relates to light emitting devices which emit light upon impingement of thermoelectrons on a front panel having fluorescent elements and where an array of cathodes and electrodes are provided on a substrate within each light emitting device. Thus, in the present invention, first electrode leads having a coefficient of thermal expansion substantially equal to that of the substrate are inserted into and through the substrate, and second electrode leads having a coefficient of thermal expansion substantially equal to that of the rear panel are inserted into and through the rear panel, and the first and second electrode leads are connected such that the substrate is supported at a distance above the rear panel.

2 Claims, 13 Drawing Sheets

FIG. 7
(PRIOR ART)
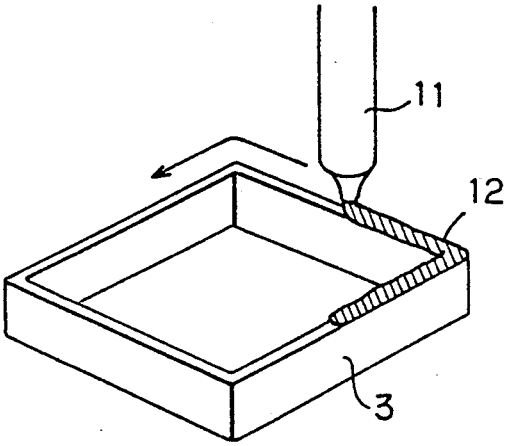
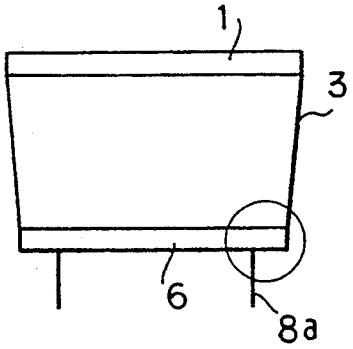
FIG. 8(a)
(PRIOR ART)
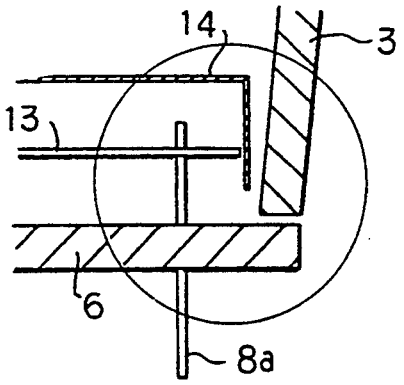
FIG. 8(b)
(PRIOR ART)

FIG. 13(a)
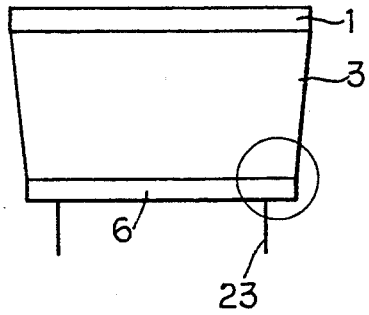
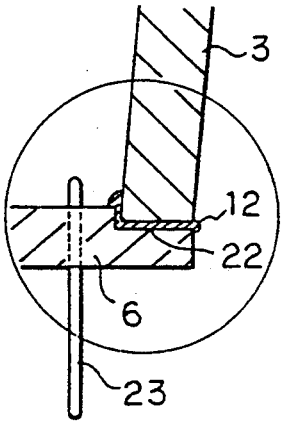
FIG. 13(b)

FIG.20(a)
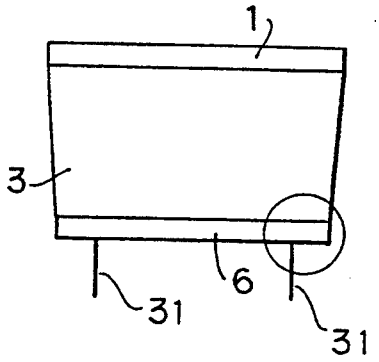
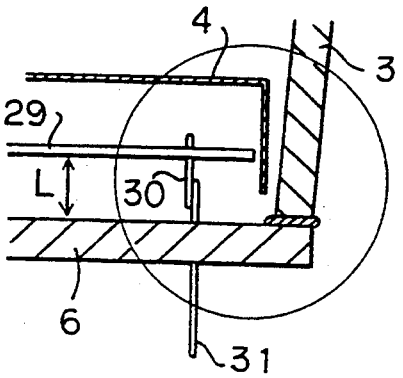
FIG. 20(b)

LIGHT EMITTING DEVICE RESISTANT TO DAMAGE BY THERMAL EXPANSION

This application is a divisional of application Ser. No. 07/851,462, filed Mar. 12, 1992, (now U.S. Pat. No. 5,304,083, issued Apr. 19, 1994).

BACKGROUND OF THE INVENTION

1. Field of the Invention

The present invention relates to a light emitting device as a constituent member of a large screen apparatus used in a stadium or the like.

2. Description of the Prior Art

FIG. 1(*a*) is an exploded perspective view of a conventional light emitting device disclosed in Japanese Patent Laid Open No. 100854/89 for example. In the same figure, the reference numeral 1 denotes a front panel on which are arranged fluorescent elements 2 in a matrix form and which covers one opening portion of a square frame-like spacer 3; the numeral 4 denotes a shielding electrode having openings 5 in corresponding relation to the fluorescent elements 2 arranged on the front panel 1; numeral 6 denotes a rear panel having cathodes 7 arranged thereon in corresponding relation to the fluorescent elements 2 to emit thermoelectrons for causing the fluorescent elements 2 arranged on the front panel 1 to emit light, the rear panel 6 covering the other opening portion of the spacer 3; numeral 8*a* denotes a first control electrode (scan electrode) for the cathodes 7; numeral 8*b* denotes a second control electrode (data electrode) for the cathodes 7; numerals 9*a* and 9*b* denote wiring patterns for connecting the scan electrodes 8*a* and data electrodes. 8*b* in common in the direction of row or column; and numeral 10 denotes an exhaust portion. Hereinafter, a space 3*a* surrounded by the spacer 3 will be designated the interior of the spacer, and each inside wall surface 3*b* will be referred to as the inner side face. In some cases, the front panel 1 also serves as an anode. In the case where the front panel 1 does not serve as an anode, an anode is disposed between the front panel and the shielding electrode 4.

FIG. 2 is a wiring diagram showing wiring on the rear panel 6. In the same figure, S1 to S4 represent lead-out portions for the scan electrodes 8*a* connected in common in the row direction, while D1 to D4 represent lead-out portions for the data electrodes 8*b* connected in common in the column direction. FIG. 3 shows timings of signals applied to the scan electrodes 8*a* and data electrodes 8*b*. FIG. 4 shows a correlation between the arrangement of picture elements P11–P44 and the electrodes, and FIG. 5 explains the potential of each electrode and the flow of electrons. Further, FIG. 6 shows an example of a display comprising a number of (two in the figure) light emitting devices A1, A2.

The operation of such a conventional light emitting device will be described below. According to the basic principle of this type of a light emitting device, thermoelectrons emitted from the cathodes 7 are accelerated and strike against the fluorescent elements 2 arranged on the front panel 1, whereby the fluorescent elements 2 are excited and emit light.

Thermoelectrons emitted from a cathode 7 behave as follows according to potential combinations of scan electrode 8*a* and data electrode 8*b*, as shown in FIG. 5.

(1) In the case where both a scan electrode 8*a* connected in the row direction and a data electrode 8*b* connected in the column direction are positive relative to a cathode 7:

Thermoelectrons emitted from the cathode 7 by the positive potential of the data electrode 8*b* are deflected by the potential of the scan electrode 8*a* and reach an anode to cause a fluorescent element 2 to emit light.

(2) In the case where the scan electrode 8*a* is positive and the data electrode 8*b* is negative:

The potential near the cathode 7 becomes negative under the negative potential of the data electrode 8*b* close to the cathode 7, whereby the emission of thermoelectrons is suppressed, so that the fluorescent element 2 does not emit light.

(3) When the scan electrode 8*a* is negative and the data electrode 8*b* is positive, there are the following two cases.

a. In the case where an adjacent scan electrode 8*a* is positive, thermoelectrons emitted from the cathode 7 are deflected toward the adjacent scan electrode 8*a* by the negative potential of the scan electrode 8*a* in question, so the fluorescent element 2 does not emit light.

b. In the case where the adjacent scan electrode 8*a* is also negative, although the potential of the data electrode 8*b* is positive, because of a small area of the data electrode, the potential in the vicinity of the cathode 7 becomes negative under the influence of the negative potential of both side scan electrodes 8*a*, whereby the emission of thermoelectrons is suppressed and so the fluorescent element 2 does not emit light.

(4) In the case of both scan electrode 8*a* and data electrode 8*b* being negative, the potential in the vicinity of the cathode 7 becomes negative, whereby the emission of thermoelectrons is suppressed and so the fluorescent element 2 does not emit light.

As a result, from the relation between the wiring illustrated in FIG. 2 and arrangement of fluorescent elements 2 in FIG. 4, the fluorescent element 2 positioned at an intersecting point of positive potential, applied to scan electrode 8*a* and data electrode 8*b*, emits light. First, when a signal is applied to S1, P11 to P14 are selected and emit light in accordance with the potential of data electrodes 8*b* (D1 to D4).

Next, when a signal is applied to S2, P21 to P24 are selected and emit light also in accordance with the potential of data electrodes 8*b*. Therefore, as shown in FIG. 3, any desired display can be obtained by successively applying scan signals to the scan electrodes 8*a* and optional data signals to the data electrodes 8*b*.

The following description is now provided about a sealing process for the conventional light emitting device.

First, in bonding the spacer 3 to the front panel 1 and also to the rear panel 6, as shown in FIG. 7, frit glass 12 is applied uniformly to each bonding surface of the spacer 3 by means of a dispenser 11, and bonding is effected through the frit glass (although the frit glass 12 itself is a powder, fluidity is imparted thereto by mixing it with a suitable solvent).

At the time of bonding, the scan electrodes 8*a* and data electrodes 8*b* are drawn out from the spacer rear panel bonded portion to permit the transmission of signals between the light emitting device and an external device (not shown). In this way the sealing process is carried out.

FIG. 6 shows an example of a display comprising a number of light emitting devices A1, A2. It is seen from this figure that in order to make the joint portion between adjacent light emitting devices A1 and A2 inconspicuous, it is necessary to provide between adjacent light emitting elements 2 in each light emitting device a space T2 which is twice or more as large as a dead space (width T1) provided around the light emitting device.

FIG. 8 shows an example in which cathodes 7, etc. are provided on a ceramic substrate 13, not on the rear panel 6. In this case, scan electrodes 8*a* and data electrodes 8*b* are drawn out to the exterior through both the ceramic substrate 13 and the rear panel 6. The numeral 14 denotes a shielding electrode.

Since the conventional light emitting device is constructed as above, when frit glass is applied uniformly onto each bonding surface of the spacer 3, it is necessary that the amount of frit glass discharged from the dispenser nozzle and the moving speed of the dispenser be always kept constant. However, this is difficult particularly at the corner portions, thus sometimes the amount of frit glass applied is not uniform in some points. Consequently, as shown in FIG. 9, there may occur protrusion of frit glass, or as shown in FIGS. 10 and 11, there may occur a positional deviation, or displacement, between the spacer 3 and the front panel 1 and also between the spacer and the rear panel 6 (imbalance in pressure against the panels may be another cause of such displacement). Therefore, it is necessary to grind the protruded portion (the grinding may cause fine flaws, resulting in deterioration in strength of the glass). There may arise further problems such as deterioration of the mechanical accuracy and variations in luminance. The openings of the shielding electrode 4 which emit electrons are influenced by static electricity of the inner side faces of the spacer 3. Since the inner side faces of the spacer 3 are positively charged, if the openings of the shielding electrode 4 approach the spacer 3 due to displacement of the rear panel 6, the openings are strongly influenced by the positive potential of the inner side faces of the spacer 3, whereby the emission of electrons is accelerated. As a result, the luminance of the corresponding fluorescent element increases. On the other hand, as the said openings go away from the spacer 3, the luminance decreases. Thus, in the interior of the light emitting device there occur variations in luminance.

In the case where the scan electrodes 8*a* and data electrodes 8*b* are drawn out to the exterior through the ceramic substrate 13 and the rear panel 6, as shown in FIG. 8, a stress is induced in the ceramic substrate 13 due to the difference in thermal expansion coefficient among the ceramic substrate 13, rear panel 6, scan electrodes 8*a* and data electrodes 8*b*, resulting in cracking of the ceramic substrate.

SUMMARY OF THE INVENTION

The present invention has been accomplished for overcoming the above-mentioned problems and it is the object of the invention to prevent displacement of the bonding surfaces of the spacer with respect to the front panel, rear panel, or shielding electrode to thereby obtain a light emitting device of high accuracy free of variations in luminance and reduce the dead space between light emitting devices A1 and A2, thereby affording a display of high resolution.

In a light emitting device according to the present invention, the front panel and the spacer are bonded together, and the rear panel and the spacer are also bonded together, each through pre-molded frit glass. Therefore, frit glass is applied uniformly to the bonded portions.

In another light emitting device according to the present invention, the portion of the rear panel to be bonded to the spacer has a difference in height for fitting with the spacer to prevent displacement between the rear panel and the spacer.

In still another light emitting device according to the present invention, there is provided an anode which is fixed to the front panel in the interior of the spacer and which accelerates thermoelectrons emitted from cathodes. The anode is provided at the outer periphery thereof with a plurality of elastic elements which are brought into abutment with the inner side faces of the spacer. Thus, the spacer is fixed by the anode to prevent displacement between the front panel and the spacer.

Further, a light emitting device wherein a shielding electrode is inserted between the front panel and the substrate so that a plurality of elastic elements provided along the outer periphery of the shielding electrode come into abutment with the inner side faces of the spacer, is also covered by the present invention. In this light emitting device, since the spacer is fixed by the shielding electrode, the displacement between the shielding electrode and the spacer is prevented.

Also covered by the present invention is a light emitting device having first electrode leads, the first electrode leads having a thermal expansion coefficient substantially equal to that of a substrate, inserted into the substrate to support the substrate and connected to control electrodes for cathodes arranged on the substrate, and also having second electrode leads, the second electrode leads having a thermal expansion coefficient substantially equal to that of a rear panel, inserted into the rear panel and connected to the first electrode lead. In this light emitting device, the gap between the substrate and the rear panel absorbs a stress induced in the substrate because of the difference in thermal expansion coefficient between the substrate and the rear panel.

BRIEF DESCRIPTION OF THE DRAWINGS

FIG. 1(*b*) is a perspective view of the conventional light emitting device of FIG. 1(*a*) as assembled;

FIG. 7 is a perspective view for explaining how to apply frit glass to a spacer;

FIG. 8 is a sectional view of a conventional light emitting device having a ceramic substrate;

FIG. 12(*b*) is a perspective view of the light emitting device of FIG. 12(*a*) as assembled;

FIG. 13 is a sectional view of a light emitting device according to a second embodiment of the present invention;

FIG. 14(*b*) is a perspective view of the light emitting device of FIG. 14(*a*) as assembled;

FIG. 16(*b*) is a perspective view of the light emitting device of FIG. 16(*a*) as assembled;

FIG. 19(*b*) is a perspective view of the light emitting device of FIG. 19(*a*) as assembled; and FIG. 20 is a sectional view thereof.

DETAILED DESCRIPTION OF THE PREFERRED EMBODIMENTS

Figure 1A:
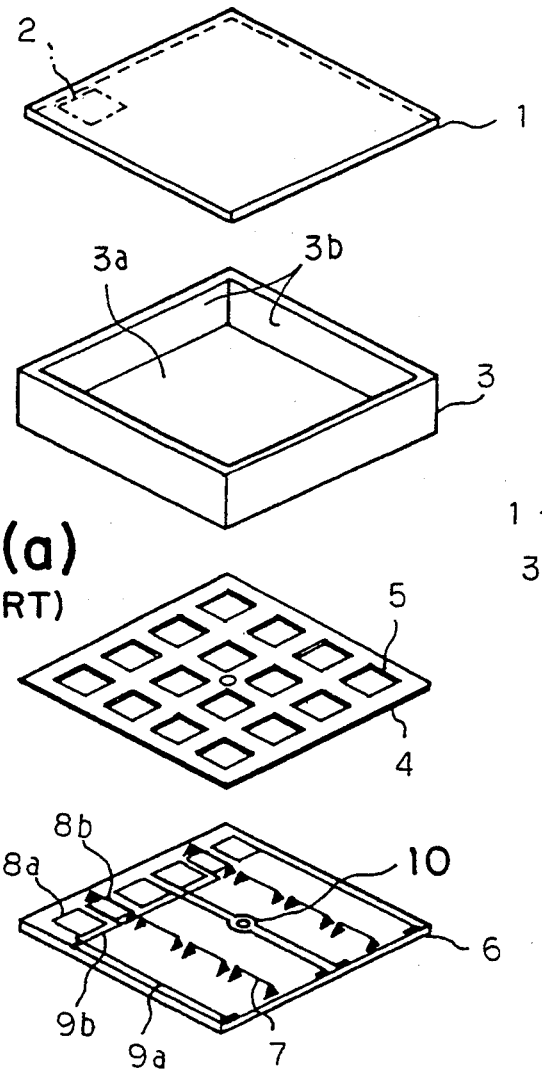
FIG. 1(a) (PRIOR ART)
FIG. 1(*a*) is an exploded perspective view of a conventional light emitting device.
Figure 1B:
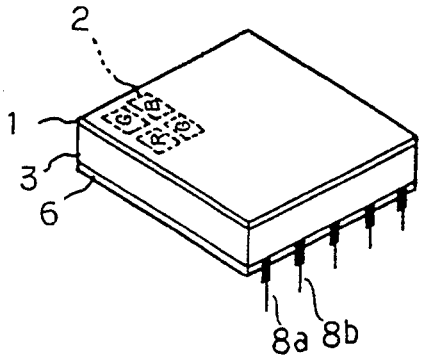
FIG. 1(b) (PRIOR ART)
Figure 2:
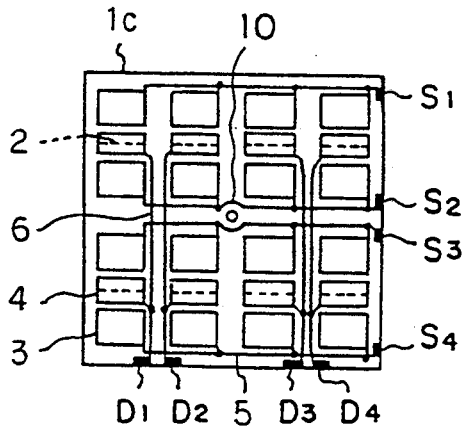
FIG. 2 (PRIOR ART)
FIG. 2 is a wiring diagram showing wiring of control electrodes in the light emitting device.
Figure 3:
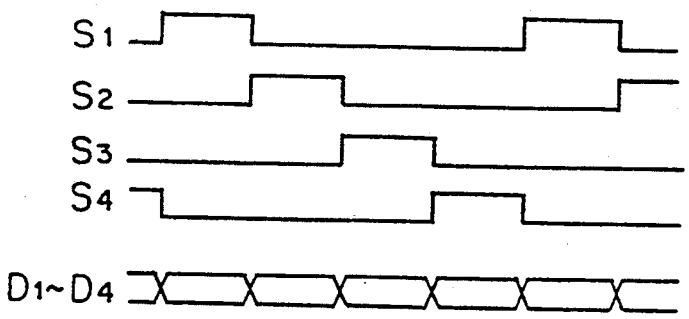
FIG. 3 (PRIOR ART)
FIG. 3 is a timing chart showing signals applied to the control electrodes and data electrodes.
Figure 4:
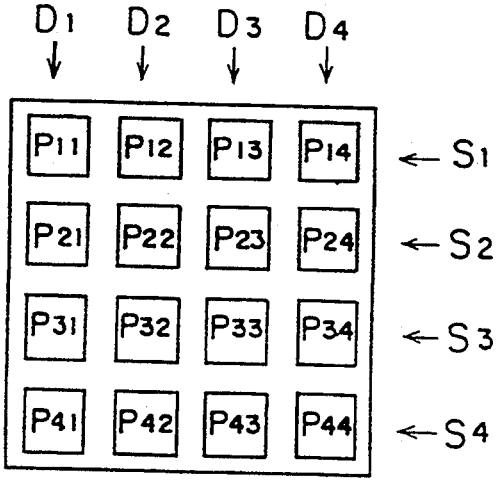
FIG. 4 (PRIOR ART)
FIG. 4 is an explanatory view showing a correlation between picture elements and electrodes.
Figure 5:
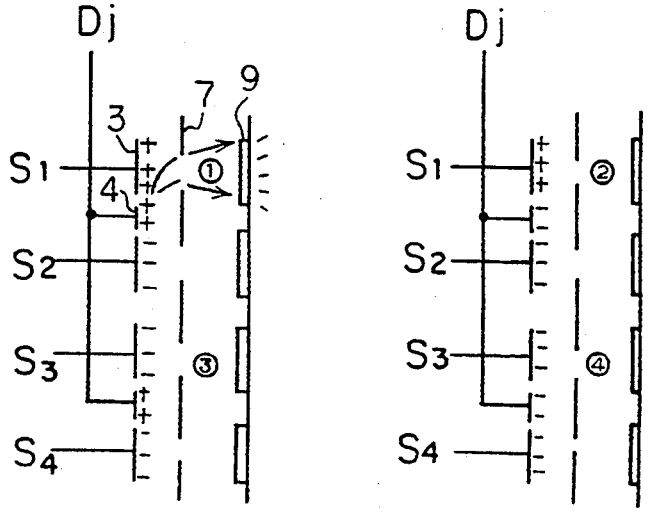
FIG. 5 (PRIOR ART)
FIG. 5 is an explanatory view showing the polarity of electrodes and the flow of electrons.
Figure 6:
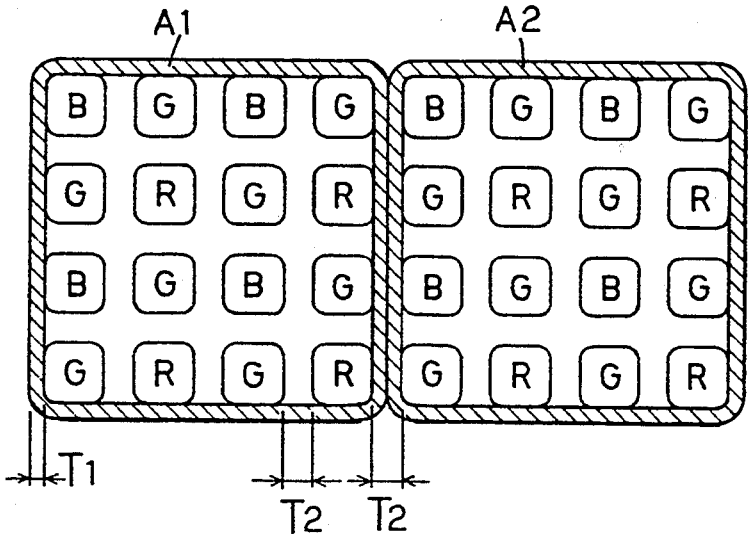
FIG. 6 (PRIOR ART)
FIG. 6 is an explanatory view showing two adjacent light emitting devices.
Figure 9A:
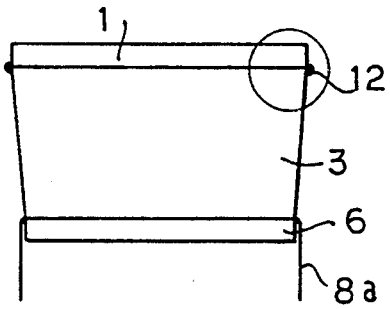
FIG. 9(a) (PRIOR ART)
FIG. 9 is a sectional view of the conventional light emitting device showing a protrusion of frit glass.
Figure 9B:
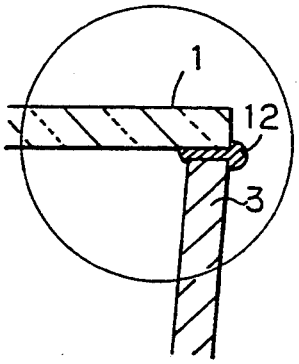
FIG. 9(b) (PRIOR ART)
Figure 10A:
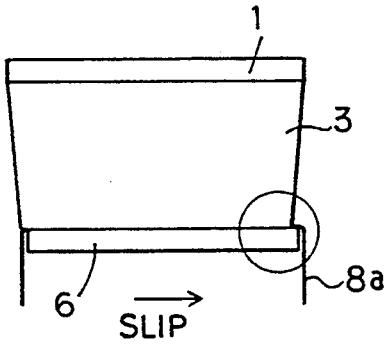
FIG. 10(a) (PRIOR ART)
FIG. 10 is a sectional view of the conventional light emitting device showing a displaced state between a rear panel and a spacer.
Figure 10B:
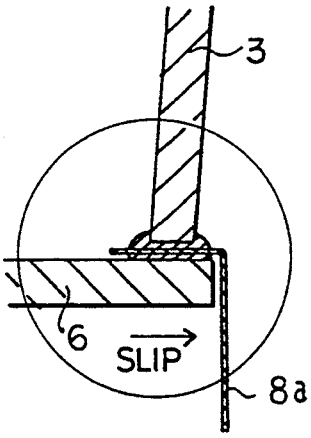
FIG. 10(b) (PRIOR ART)
Figure 11A:
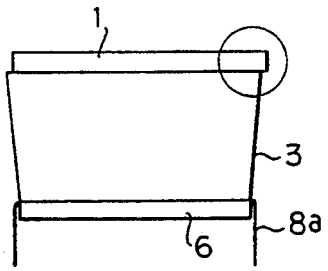
FIG. 11(a) (PRIOR ART)
FIG. 11 is a sectional view of the conventional light emitting device showing a displaced state between a front panel and the spacer.
Figure 11B:
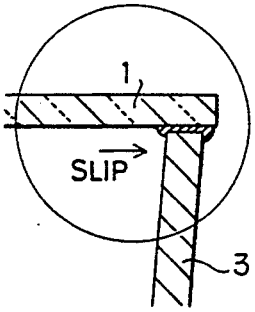
FIG. 11(b) (PRIOR ART)
Figure 12A:
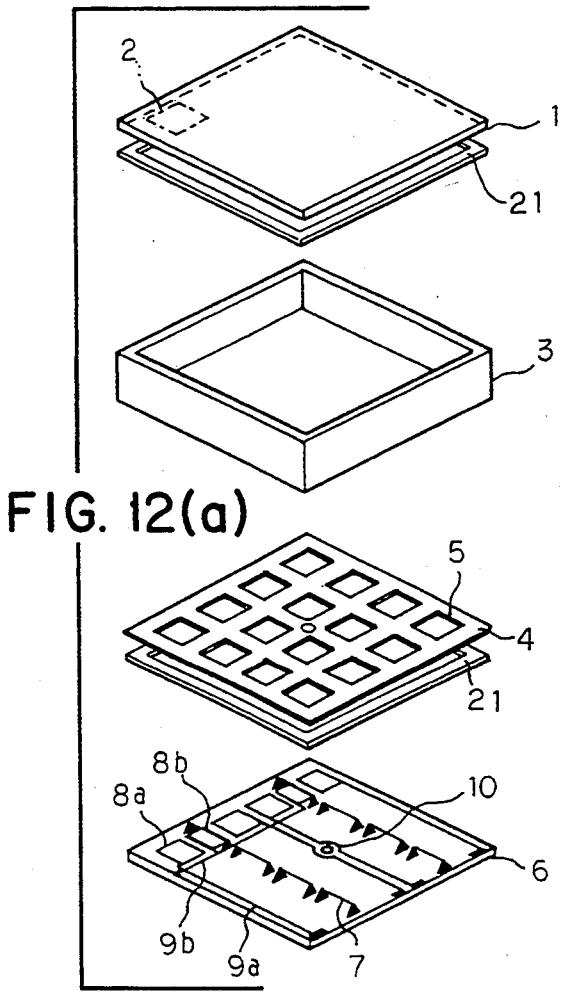
FIG. 12(*a*) is an exploded perspective view of a light emitting device according to a first embodiment of the present invention.
Figure 12B:
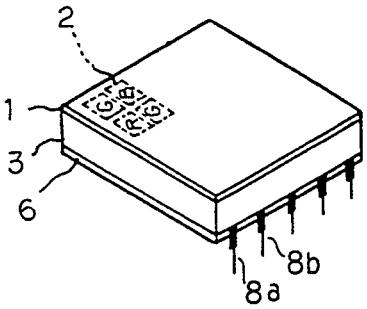

An embodiment of the present invention will now be described with reference to FIG. 12(*a*) which is an exploded perspective view of a light emitting device according to a first embodiment of the present invention and FIG. 12(*b*) which is a perspective view of the light emitting device as assembled. In these figures, the same reference numerals indicate the same or corresponding portions as in the prior art, so explanation thereof will be omitted. Numeral 21 denotes molded frit glass.

In operation, frit glass is first molded, in the following manner. First, frit glass powder is mixed with a binder (a resinous organic material for solidifying the powdered frit), using a solvent. The resulting mixture is pressed by a die while in a state of fluidity. The thus-molded mixture is dried and thereby solidified into a predetermined shape. In this way there is obtained a molded frit glass 21.

Then, in a sealing process, the molded frit glass 21 is inserted between a front panel 1 and a spacer 3 and also between a rear panel 6 and the spacer 3, followed by heating, whereby the frit glass 21 is softened to complete bonding between each of the front and rear panels 1, 6 and the spacer 3.

The solvent and binder which have been used for the molding of the frit glass 21 are evaporated by the sealing heat. In this case, unlike the case where the application of frit glass is performed using the dispenser 11, it is possible to mold the frit glass 22 accurately into a shape which is determined by the die used, so that in the sealing process there is no longer protrusion of frit glass caused by a quantitative non-uniformity of the frit glass, thus permitting satisfactory bonding. Consequently, it is not necessary to grind protruded frit glass.

FIG. 13 is a sectional view of a Light emitting device according to a second embodiment of the present invention. In the same figure, the numeral 22 denotes a difference in height, or a stepped portion for fitting with the spacer 3, formed in the portion of the rear panel 6 to be bonded with the spacer 3, and the numeral 23 denotes a control electrode for a cathode extending to the exterior through the rear panel 6.

In operation, first frit glass is applied to a bonding surface of the spacer 3 and thereafter the rear panel 6 and the spacer 3 are combined together, followed by heating. As the frit glass melts, the rear panel 6 and the spacer 3 are fitted together, whereby the displacement of the two is suppressed. As a result, there is obtained a light emitting device of high accuracy free of variations in luminance.

Figure 14A:
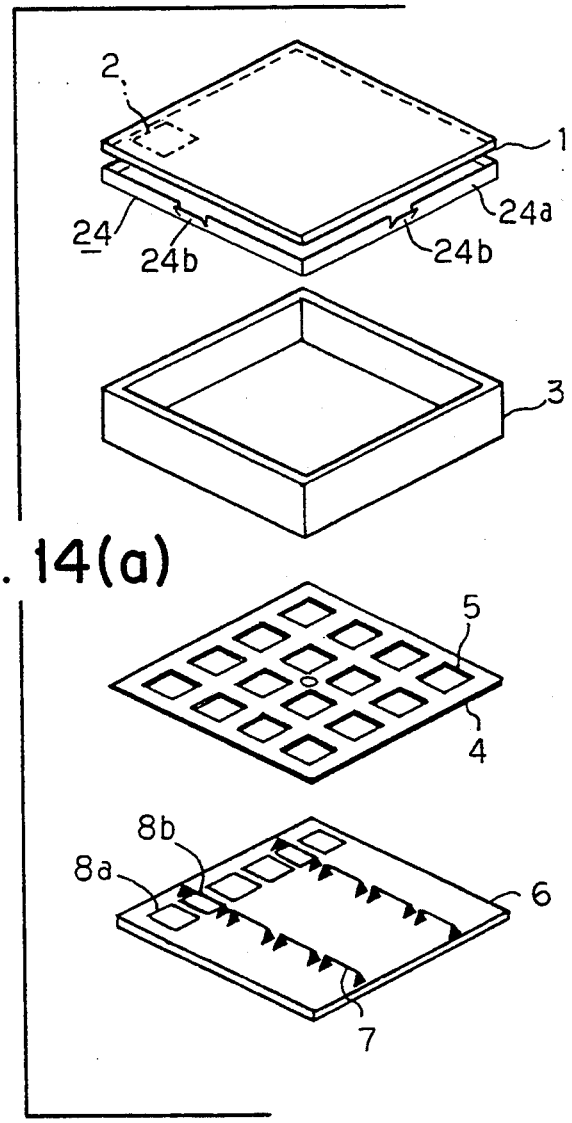
FIG. 14(*a*) is an exploded perspective view of a light emitting device according to a third embodiment of the present invention.
Figure 14B:
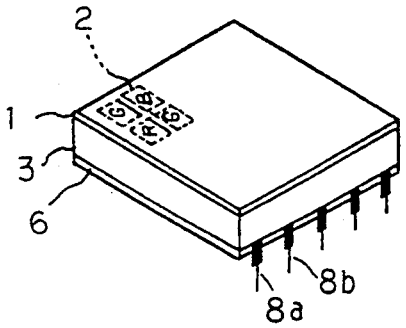
Figure 15A:
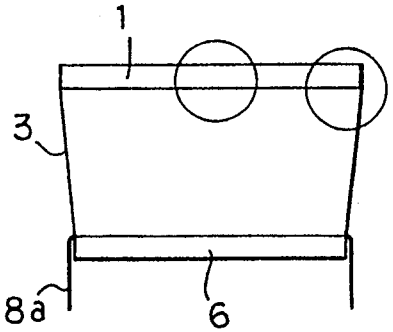
FIG. 15 is a sectional view thereof.
Figure 15B:
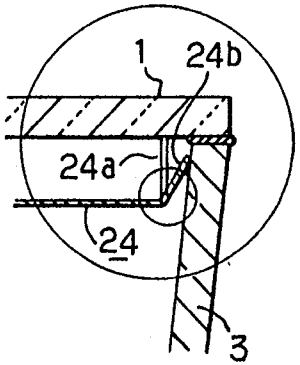
Figure 15C:
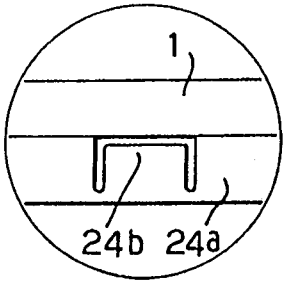
Figure 15D:
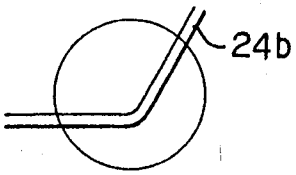
Figure 15E:
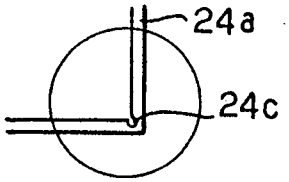

FIG. 14(*a*) is an exploded perspective view of a light emitting device according to a third embodiment of the present invention, FIG. 14(*b*) is a perspective view of the light emitting device as assembled, and FIG. 15 is a partial sectional view of the light emitting device illustrated in FIG. 14(*b*). In these figures, the numeral 24 represents a plate-like anode having four upright portions. The anode 24 is fixed to a front panel 1 in the interior of a spacer 3 and accelerates thermoelectrons emitted from cathodes 7. Numeral 24*a* denotes an upright portion of the anode 24, numeral 24*b* denotes a springy projection (an elastic piece) formed by making a cut into a part of the upright portion 24*a* and changing the bending angle, and numeral 24*c* denotes half etching applied onto a boundary line between the upright portion 24*a* and a body portion (plate-like portion) of the anode 24 (exclusive of the portion where the projection 24*b* is present). It goes without saying that openings corresponding to fluorescent elements 2 are present in the body portion of the anode 24.

The operation of this light emitting device will be described below.

Prior to the sealing process, the anode 24 is formed by molding in such a shape as shown in FIG. 14(*a*). More specifically, a cut is made in each of the portions where the projections 24*b* are to be formed of a square flat plate whose four corners have been cut off, and half etching is applied onto a boundary line between the portion corresponding to the body portion of the flat plate and each upright portion 24*a*. Thereafter, the boundary lines are bent at a right angle. In this way there is obtained an anode 24 having upright portions 24*a*. Provided, however, that half etching is not applied to the portions where the springy projections 24*b* are formed, in which portions, moreover, the bending angle should be smaller than 90°. The anode 24 is bonded to the front panel 1 using frit glass which softens at a higher temperature.

In the sealing process, as shown in FIG. 15, since the projections 24*b* of the anode are kept in abutment with the spacer 3 with a predetermined elasticity, there will occur no displacement between the anode 24 and the spacer 3 even when the frit glass applied between the front panel 1 and the spacer 3 softens, nor will there be any displacement between the front panel 1 and the spacer 3 because the anode 24 is fixed to the front panel 1. As a result, there is obtained a light emitting device of high accuracy free of variations in luminance.

Figure 16A:
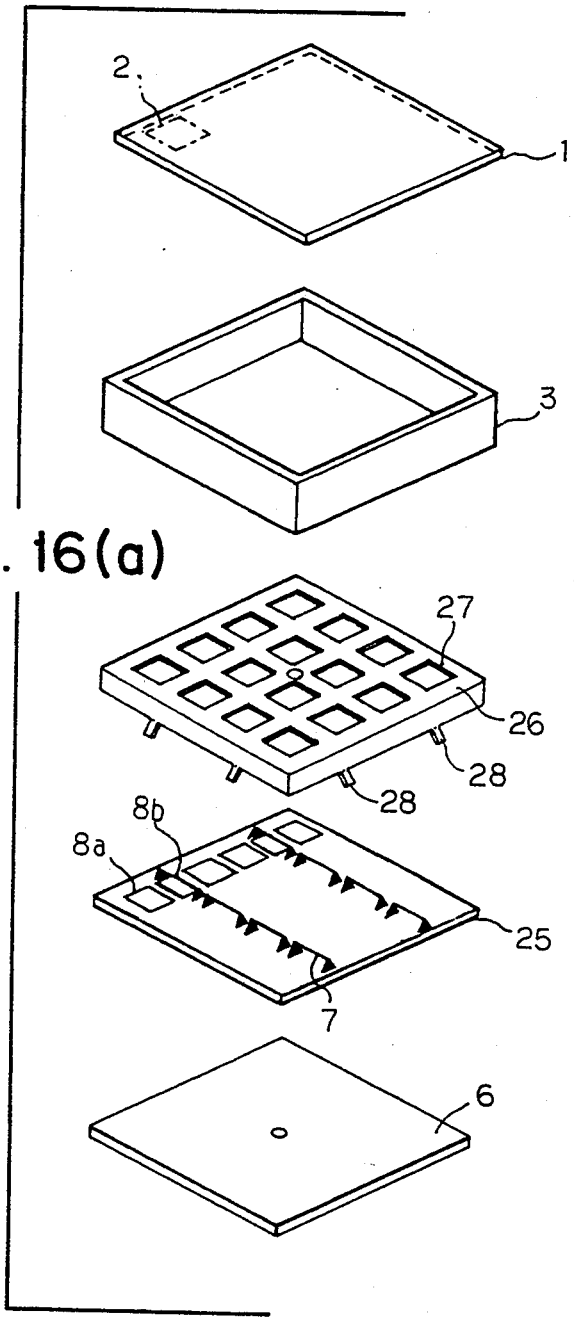
FIG. 16(*a*) is an exploded perspective view of a light emitting device according to a fourth embodiment of the present invention.
Figure 16B:
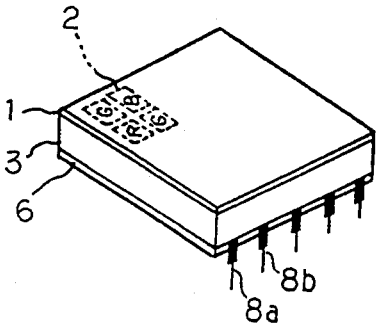
Figure 17A:
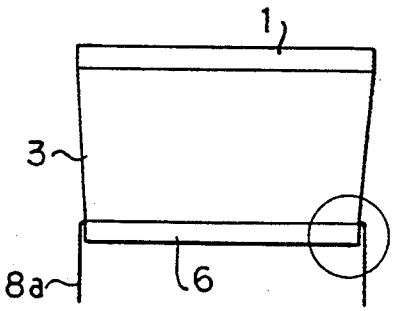
FIG. 17 is a sectional view thereof.
Figure 17B:
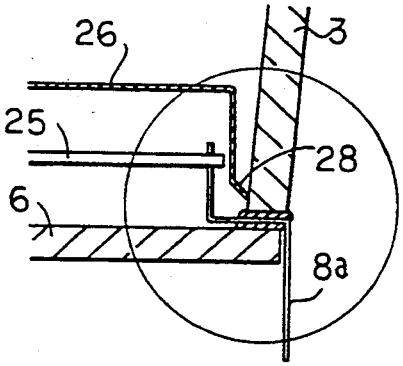

FIG. 16(*a*) is an exploded perspective view of a light emitting device according to a fourth embodiment of the present invention, FIG. 16(*b*) is a perspective view of the light emitting device as assembled, and FIG. 17 is a sectional view of the light emitting device illustrated in FIG. 16(*b*). In these figures, numeral 6 denotes a rear panel [cathodes 7, etc. are not formed thereon as shown in FIG. 16(*a*)]; numeral 25 denotes a substrate on which are arranged thermoelectron emitting cathodes 7 in corresponding relation to fluorescent elements 2 arranged on a front panel 1 for causing the fluorescent elements to emit light and which is placed on the rear panel 6 while being supported by scan electrodes 8*a* and data electrodes 8*b* drawn out from the cathodes 7; numeral 26 denotes a shielding electrode inserted between the front panel 1 and the substrate 25 and having a plurality of springy projections (elastic pieces) 28 projecting from the outer peripheral portion of the shielding electrode, the projections. 28 coming into abutment with the inner side faces of a spacer 3 to thereby retain the shielding electrode on those inner side faces of the spacer; and numeral 27 denotes an opening of the shielding electrode 26.

The following description is now provided about the operation of this light emitting device.

Prior to the sealing process, the shielding electrode 26 is molded in a cover shape, as shown in FIG. 16(*a*). Then, the shielding electrode 26 is disposed so as to cover the substrate 25. It is desirable that when the shielding electrode 26 is thus disposed, the springy projections 28 be positioned lower than the rear surface of the substrate 25, that is, be provided on the rear panel 6 side (see FIG. 17). This is for isolating the substrate 25 and the inner surfaces of the spacer 3 from each other to prevent the spacer inner side faces which are charged at a high potential close to the anode potential from drawing out extra electrons from the cathodes (the leakage of surplus electrons may cause an erroneous emission of light).

In the sealing process, since the projections 28 of the shielding electrode 26 are kept in abutment with the spacer 3 with a predetermined elasticity, as shown in FIG. 17, there will occur no displacement between the shielding electrode 26 and the spacer 3 even when the frit glass applied between the rear panel. 6 and the spacer softens. As a result, there is obtained a light emitting device of high accuracy free of variations in luminance.

Figure 18:
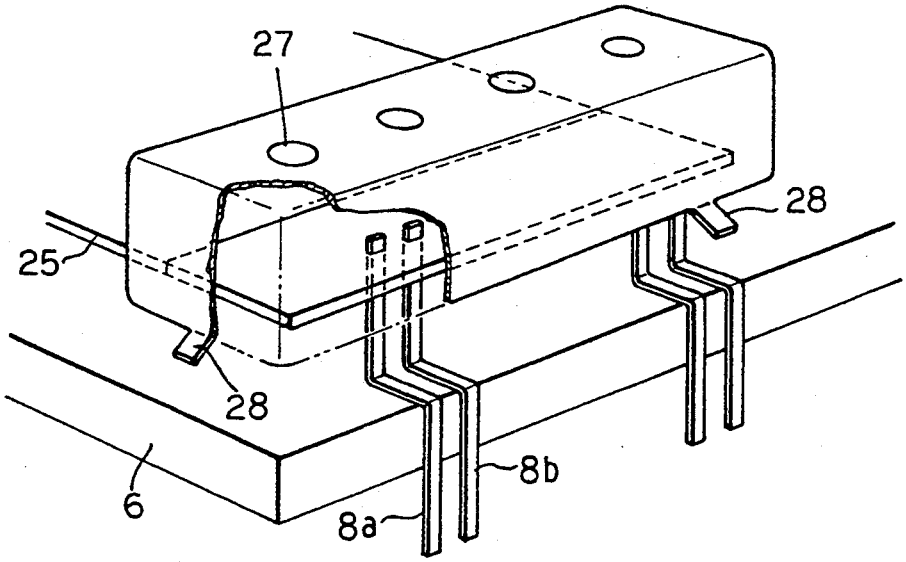
FIG. 18 is a partial perspective view thereof.

Although, as to the electrode having the springy projections 28, there has been shown as an example the shielding electrode 26 common to all fluorescent elements 2 and in contact with the spacer 3, there may be used an electrode common to some of the fluorescent elements 2, fixed to the rear panel 6 and having surfaces which are in close proximity to the inner side faces of the spacer 3, as shown in FIG. 18. In this case, there are provided plural such electrodes (FIG. 18 shows only one of them).

Figure 19A:
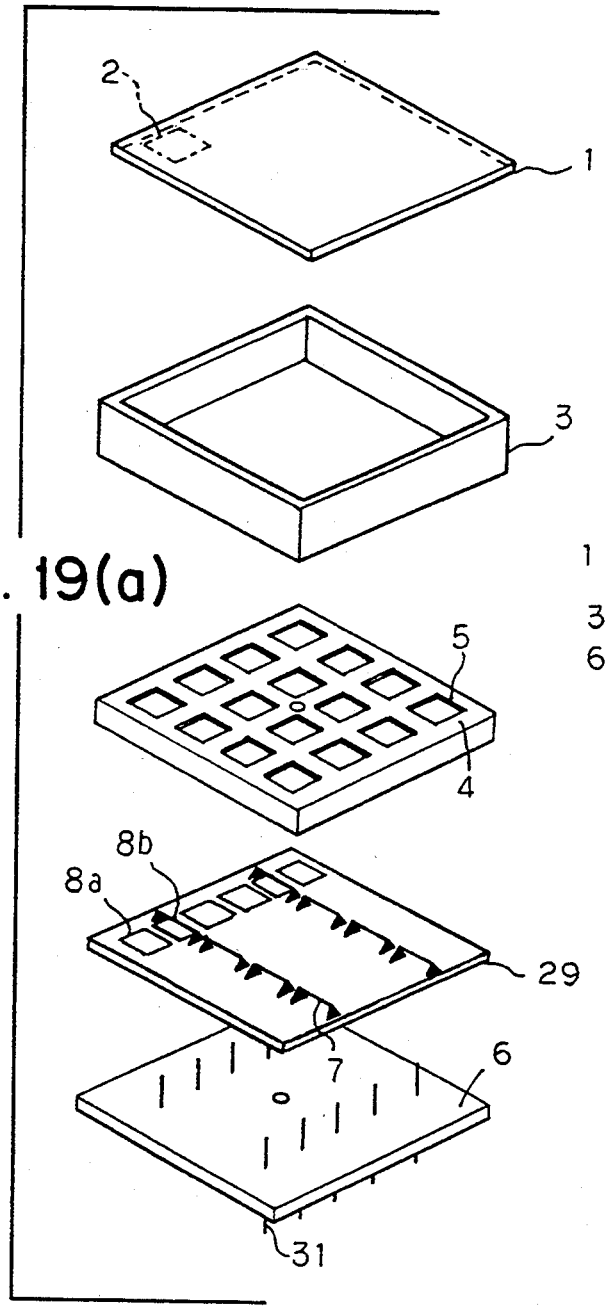
FIG. 19(*a*) is an exploded perspective view of a light emitting device according to a sixth embodiment of the present invention.
Figure 19B:
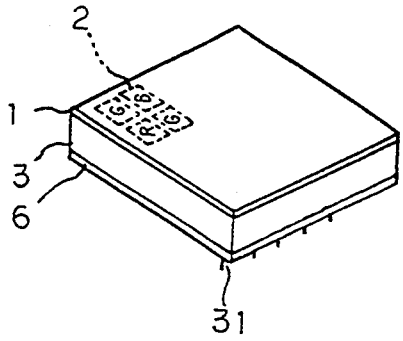

FIG. 19(*a*) is an exploded perspective view of a light emitting element according to a sixth embodiment of the present invention, FIG. 19(*b*) is a perspective view of the light emitting element as assembled, and FIG. 20 is a sectional view of the light emitting device illustrated in FIG. 19(*b*). In these figures, numeral 29 denotes a ceramic substrate inserted in the vicinity of a rear panel 6 in the interior of a spacer 3 and with thermoelectron emitting cathodes being arranged thereon in corresponding relation to fluorescent elements 2 arranged on a front panel 1 for causing the fluorescent elements to emit light; numeral 30 denotes a first electrode lead having a thermal expansion coefficient substantially equal to that of the ceramic substrate 29, extending through the ceramic substrate to support the same substrate and connected to scan electrodes 8*a* and data electrodes 8*b* for the cathodes arranged on the ceramic substrate 29; and numeral 31 denotes a second electrode lead having a thermal expansion coefficient substantially equal to that of the rear panel 6, inserted into the rear panel and connected to the first electrode lead 30.

The operation of this light emitting device will be described below.

First, the first electrode leads 30 having a thermal expansion coefficient substantially equal to that of the ceramic substrate 29 are connected through the ceramic substrate 29 to the scan electrodes 8*a* and data electrodes 8*b*. Next, the second electrode leads 31 having a thermal expansion coefficient substantially equal to that of the rear panel 6 are connected through the rear panel to the first electrode leads 30. At this time, the ceramic substrate 29 is mounted in a floating state at a distance of gap L from the rear panel 6 through the first electrode leads 30. In this state, a stress induced due to the difference in thermal expansion coefficient between the ceramic substrate 29 and the rear panel 6 is absorbed by the gap L. Therefore, even if the second electrode leads 31 pass through the rear panel, there arises no inconvenience. For arranging light emitting devices closely to each other, it is preferable that the electrode leads of the light emitting devices be drawn out through the rear panel 6 rather than drawn out from the sealed portion between the spacer 3 and the rear panel 6, because the spacing between adjacent light emitting devices can be narrowed.

Although in the above embodiments, the correlation between the cathodes 7 and the fluorescent elements 2 is 1:2, it may be 1:1 or 1:n.

Further, although the light emitting devices described in the above embodiments are based on the CRT principle, the present invention is also applicable to light emitting devices based on the principle of a discharge tube or the like.

As set forth above, when the front panel and the spacer, as well as the rear panel and the spacer, are bonded by premolded frit glass, the frit glass is applied uniformly to the bonding surfaces of the spacer, so that the protrusion of the frit glass is prevented, that is, grinding for a protrusion of frit glass is not necessary. Besides, the dead space T1 becomes smaller and it is possible to realize a high resolution display.

In the case where a stepped portion for fitting with the spacer is formed in the bonding surface of the rear panel, the rear panel and the spacer are fitted together with melting of frit glass in the sealing process, so the displacement between the rear panel and the spacer is suppressed, whereby there is obtained a light emitting device of high accuracy free of variations in luminance.

In the case where a plate-like anode fixed to the front panel, having upright portions and functioning to accelerate thermoelectrons emitted from cathodes, is provided with a plurality of elastic pieces at the upright portions which elastic pieces are in abutment with inner side faces of the spacer, the displacement between the front panel and the spacer is suppressed because the spacer is positioned by the anode, whereby there is obtained a highly accurate light emitting device free of variations in luminance.

In the case where a shielding electrode, having a plurality of elastic pieces formed on the outer periphery thereof and in abutment with inner side faces of the spacer for retaining on those inner side faces, is inserted between the front panel and the substrate, the displacement between the shielding electrode and the spacer is suppressed because the spacer is positioned by the shielding electrode, whereby there is obtained a highly accurate light emitting device free of variations in luminance.

In the case where the first electrode leads having a thermal expansion coefficient substantially equal to that of the substrate and the second electrode leads having a thermal expansion coefficient substantially equal to that of the rear panel are connected together, a stress induced due to the difference in thermal expansion coefficient between the substrate and the rear panel is absorbed at the portion of the gap L, so even when the second electrode leads are provided through the rear panel, there will arise no inconvenience such as cracking of the substrate for example, thus permitting a closely-spaced arrangement of light emitting devices.

What is claimed is:

1. A light emitting device comprising:

a front panel on which fluorescent elements are arranged in a matrix form;

a substrate on which cathodes are arranged in a corresponding relation to said fluorescent elements, said cathodes emitting thermoelectrons for causing the fluorescent elements to emit light;

a square frame-like spacer, one opening portion of said spacer being covered with said front panel and the other opening portion thereof covered with a rear panel;

first electrode leads having a thermal expansion coefficient substantially equal to that of said substrate, said first electrode leads being inserted into said substrate to support the substrate and connected to control electrodes for said cathodes arranged on the substrate; and second electrode leads having a thermal expansion coefficient substantially equal to that of said rear panel, said second electrode leads being inserted into said rear panel and connected to said first electrode leads.

2. A light emitting device according to claim 1, wherein said substrate is mounted in a floating state at a distance of a gap from said rear panel through said first and second electrode leads so as to absorb a stress-induced due to a difference in thermal expansion coefficient between the substrate and the rear panel.

* * * * *